US007625192B2

(12) United States Patent
Saito et al.

(10) Patent No.: US 7,625,192 B2
(45) Date of Patent: Dec. 1, 2009

(54) INTERNAL GEAR PUMP INCLUDING A CRESCENT

(75) Inventors: Masamitsu Saito, Gunma-ken (JP); Takatoshi Watanabe, Gunma-ken (JP); Masaru Amano, Gunma-ken (JP)

(73) Assignee: Yamada Manufacturing Co., Ltd., Gunma-ken (JP)

( * ) Notice: Subject to any disclaimer, the term of this patent is extended or adjusted under 35 U.S.C. 154(b) by 19 days.

(21) Appl. No.: 11/822,146

(22) Filed: Jul. 2, 2007

(65) Prior Publication Data

US 2008/0226484 A1 Sep. 18, 2008

(30) Foreign Application Priority Data

Mar. 16, 2007 (JP) ..... 2007-068248

(51) Int. Cl.
*F01C 1/10* (2006.01)

(52) U.S. Cl. ..... 418/170; 418/169; 418/171

(58) Field of Classification Search ..... 418/170, 418/169, 171, 164, 166, 168
See application file for complete search history.

(56) References Cited

U.S. PATENT DOCUMENTS 2,774,309 A * 12/1956 Stoyke et al. ..... 418/170
3,676,027 A * 7/1972 Molly ..... 418/170
3,785,756 A * 1/1974 Langenderfer ..... 418/170
4,155,686 A * 5/1979 Eisenmann et al. ..... 418/170
4,386,892 A * 6/1983 Stich et al. ..... 418/170
5,032,069 A * 7/1991 Parsons ..... 418/170
5,360,325 A * 11/1994 Henry et al. ..... 418/170
5,660,531 A * 8/1997 Merkle et al. ..... 418/170
6,089,841 A * 7/2000 Meernik et al. ..... 418/170
6,817,843 B2 * 11/2004 Leising et al. ..... 418/170

FOREIGN PATENT DOCUMENTS

| | | |
|---|---|---|
| JP | 50-48353 | 4/1975 |
| JP | 54-30506 | 3/1979 |
| JP | 54-63409 | 5/1979 |
| JP | 58-158183 | 10/1983 |
| JP | 59-131787 | 7/1984 |

OTHER PUBLICATIONS

Japanese Office Action dated Aug. 4, 2009 with English-language Translation.

* cited by examiner

*Primary Examiner*—Thomas E Denion
*Assistant Examiner*—Mary A Davis
(74) *Attorney, Agent, or Firm*—McGinn IP Law Group, PLLC

(57) ABSTRACT

To provide an internal gear pump capable of preventing small vibrations due to pressure differences at the outlet port side of a crescent disposed between the outer rotor and the inner rotor, so that fatigue failure does not occur in the crescent over a long time period, whereby the durability can be increased. The internal gear pump includes a rotor unit, in which an inner rotor is disposed within an outer rotor on the inner peripheral side and a crescent is disposed in the gap between the inner rotor and the outer rotor, the rotor unit being housed in a pump casing. Outer cells are formed by the crescent and the outer rotor. Inner cells are formed by the crescent and the inner rotor. Linking of the outer cells and the outlet port, and linking of the inner cells 6 and the outlet port, start substantially simultaneously.

6 Claims, 4 Drawing Sheets

INTERNAL GEAR PUMP INCLUDING A CRESCENT

BACKGROUND OF THE INVENTION

1. Field of the Invention

The present invention relates to an internal gear pump capable of preventing small vibrations generated in the crescent disposed between the outer rotor and the inner rotor due to pressure differences at the outlet port, so that fatigue failure of the crescent does not occur over a long period of time, and the durability is increased.

2. Description of the Related Art

Internal gear oil pumps frequently use trochoid-shaped rotors. Using trochoid-shaped gear teeth has the advantages that the inner and outer rotors are in rolling contact, so gear impact noise is small, and cavitation does not easily occur. Also, the height of the tooth (from the base to the top) can be made large, which has the advantage that the flow rate can be increased. On the other hand, however, with trochoid-shaped rotors the space between gear teeth (cells) is sealed by the line contact of the inner tooth form contacting the outer tooth form. Therefore, pressure is lost from the line contact portion to adjacent cells, there is the disadvantage that the pressure generated is not very high. Furthermore, for smooth rolling, there is a very small gap between the inner tooth form and the outer tooth form, and this is also a cause of loss of pressure. Also, there is a type of pump known as a crescent pump, in which a part known as the crescent is disposed between the inner rotor and outer rotor. In this form, there is line contact at a plurality of locations between the rotor teeth and the fixed crescent, so pressure cannot easily escape to adjacent cells. This has the advantage that a higher pressure can be generated compared with the normal internal gear pump with no crescent. Also, in conventional crescent pumps normal gears, in other words gears with comparatively low teeth, are generally used, so pressure fluctuations are not much of a problem. However, in recent years the requirements for greater efficiency and performance are increasing. In response to these requirements usually performance (flow rate) is improved by increasing the height of the teeth, and reducing the number of teeth. However, crescent pumps have the disadvantage that when the height of the teeth is increased and the number of teeth is reduced, outlet vibrations and cavitation can more easily occur.

As a result, by trying to improve the flow rate with trochoid gear teeth form, for which the gear impact noise is low, cavitation does not easily occur, and the height of the teeth can be formed larger, there is a danger of occurrence of fatigue failure of the crescent due to small vibrations generated by pressure fluctuations when the flow rate is high. Therefore, it was very difficult to achieve high performance with gear rotors with high teeth, in particular in pumps whose structure combined trochoid-shaped teeth rotors, for which the height of the teeth can be increased compared with normal gears, with a crescent. The more that performance (flow rate) was increased the more the fatigue failure problem increased. For example, as disclosed in Japanese Patent Application Laid-open No. S59-131787, with rotors whose tooth form approximated circular arcs at the top and the base of the teeth, the space between teeth (cells) in the parts approximated by circular arcs is narrower than the space between teeth with normal trochoid curves. Therefore the quantity of oil that can be delivered in one revolution is reduced, and the performance (flow rate) is reduced accordingly. However, the resulting pressure fluctuations are small, so conventionally this was not such a big problem, but high efficiency, high performance pumps using trochoid rotors is a big problem.

Furthermore, in that internal gear pump, there is a slight time difference between the timing that the cells formed between the inner rotor and the crescent and the cells formed between the outer rotor and the crescent link with the outlet port. In other words, in an internal gear pump, the rotation speeds of the outer rotor and the inner rotor are different. The rotation speed of the inner rotor is faster than the rotation speed of the outer rotor. Therefore, normally the time that the top of a tooth of the inner rotor separates from the crescent does not coincide with the time that the top of a tooth of the outer rotor separates from the crescent. Therefore, the time that the fluid in a cell on the outside of the crescent flows into the outlet port does not coincide with the time that the fluid in a cell on the inside of the crescent flows into the outlet port. Because one of these cells is first to link with the outlet port, a pressure difference arises between the cell on the inside of the crescent and the cell on the outside of the crescent.

This pressure difference causes small vibrations to occur in the crescent. These small vibrations could cause fatigue failure in the crescent. This phenomenon arises regardless of the shape of the teeth. It is considered that with trochoid-shaped teeth the extent of the outlet vibrations is small, but in internal gear pumps that use a crescent this problem can easily arise.

SUMMARY OF THE INVENTION

Japanese Patent Application Laid-open No. S54-30506 is a pump that solves this problem with crescents in internal gear pumps. Here an invention is disclosed in which linking grooves are provided from the outlet port to the inside and outside of the crescent, so that the pressure difference between the inside and outside of the crescent is minimized. According to the technical details of this invention, a through hole is formed in the filler piece (a member that corresponds to the crescent), and grooves are formed in the pump body.

However, when the grooves are provided, oil can flow backwards along the groove, so the flow rate could be reduced. Also, forming the through hole in the filler piece increases the number of manufacturing operations of the component, which increases the cost. Therefore, the task that the present invention aims to solve (the technical task or object) is to provide a pump with an extremely simple structure, that uses a crescent combined with rotors (including trochoid gear teeth rotors) with comparatively high gear teeth as in a trochoid rotor. Also, by optimizing the shape of the port to prevent the occurrence of pressure fluctuations, to provide a crescent pump that can use trochoid rotors and is capable of high performance, having a crescent with good durability and long life.

Therefore, as a result of diligent research by the inventors to solve this problem, the invention according to claim 1 solves this problem with an internal gear pump having therein a rotor unit, in which an inner rotor is disposed on an inner peripheral side of an outer rotor and a crescent is disposed in a gap between the inner rotor and the outer rotor, in a pump casing, wherein linking of an outlet port in the pump casing to outer cells formed by the crescent and the outer rotor, and linking of the outlet port to inner cells formed by the crescent and the inner rotor start substantially simultaneously.

The invention according to claim 2 solves this problem with an internal gear pump comprising a pump casing, an outer rotor, an inner rotor, and a crescent disposed between the outer rotor and the inner rotor, wherein the start of separation of the crescent and the top of each tooth of the outer rotor, and the start of separation of the crescent and the top of each tooth of the inner rotor occur substantially simultaneously, and linking to an outlet port occurs at the start of separation.

The invention according to claim 3 solves this problem with an internal gear pump according to the configuration described above, wherein a port projection portion, formed in an outer peripheral side of a starting end portion of the outlet port, projects along a circumferential direction and extends across the area over which the tooth top portions of the outer rotor, and a position of an end of the port projection portion is a position at which the top of each tooth of the outer rotor starts to separate from the crescent. Next, the invention according to claim 4 solves this problem with an internal gear pump according to the configuration described above, wherein the continuity area of the port projection portion and the non-projecting starting edge of the outlet port substantially coincides in shape with the end portion on an outer peripheral side of the crescent. The invention according to claim 5 solves this problem with an internal gear pump according to the configuration described above, wherein the teeth of the outer rotor and the inner rotor are in trochoidal form.

EFFECTS OF THE INVENTION

According to the invention of claim 1, linking of the outlet port within the pump casing and the outer cells formed by the crescent and the outer rotor, and linking of the outlet port with the inner cells formed by the crescent and the inner rotor starts approximately simultaneously, so it is possible to make the fluid flow simultaneously into the outlet port from the outer cells and the inner cells on both the outside and the inside of the crescent. Therefore it is possible to eliminate the difference in pressure of the fluid in the outer and inner cells. In this way, only uniform pressure acts over the crescent as a whole, and unstable pressure is not applied, so small vibrations are not generated in the crescent. Therefore the durability and the life of the oil pump is improved.

The invention according to claim 2 is an internal gear pump in which the start of separation of the crescent and the top of the teeth of the outer rotor and the start of separation of the crescent and the top of the teeth of the inner rotor occurs approximately simultaneously. Also, linking with the outlet port occurs when separation starts. Therefore the top of a tooth of the outer rotor and the top of a tooth of the inner rotor simultaneously separate from the crescent, and linking with the outlet port occurs. Therefore the fluid pressure in the outer cell and the inner cell that are linked to the outlet port is the same, so it is possible to prevent small vibrations in the crescent. Therefore the durability and life of the oil pump is improved, similar to the invention according to claim 1.

The invention according to claim 3 is an internal gear pump wherein a port projection portion is formed in the outer peripheral side of the starting portion of the outlet port, the port projection portion projects along the circumferential direction and extends across the area over which the tops of the teeth pass, and the position of the end of the port projection portion is the position at which the tops of the teeth of the outer rotor start to separate from the crescent. Therefore there is no particular need to carry out processing on the crescent.

Moreover, the very simple structure of only forming the port projection portion in the outlet port may be adopted. Moreover, there is no need to carry out any processing on the crescent, or provide linking grooves or similar, so it is possible to prevent the reduction in flow rate. Furthermore, the port projection portion only is formed in the outlet port, so this can be adequately achieved with the mold. Therefore it is possible to reduce the manufacturing cost by eliminating processing.

In the invention according to claim 4, the shape of the continuity area of the port projection portion and the non-projecting starting edge of the outlet port is similar to and approximately coincides with the shape of the end portion of the outer side of the crescent. In the invention according to claim 5, the teeth of the outer rotor and the inner rotor are in trochoidal form. Therefore it is possible to form the height of the teeth of the outer rotor and the inner rotor higher than the teeth of a normal gear pump. Therefore it is possible to increase the capacity of the cells formed by the crescent and the outer rotor and the inner rotor. Therefore it is possible to increase the flow rate that can be delivered at one time, so the efficiency of the pump can be improved.

DESCRIPTION OF THE PREFERRED EMBODIMENTS

Figure 1A:
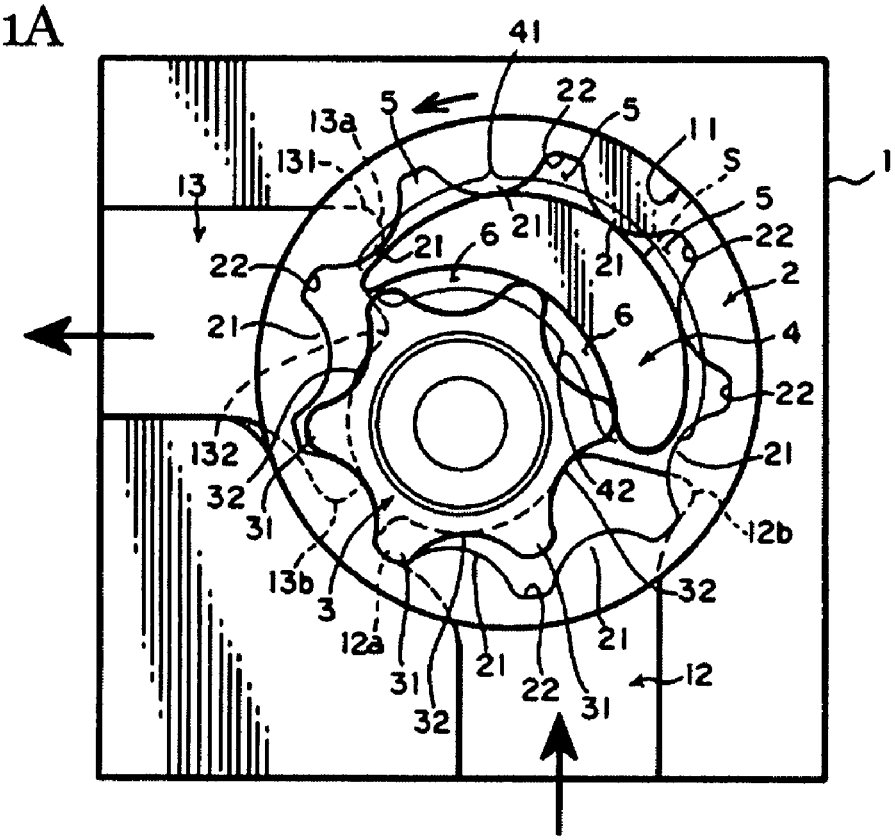
FIG. 1A is a plan view showing the structure of the present invention.
Figure 1B:
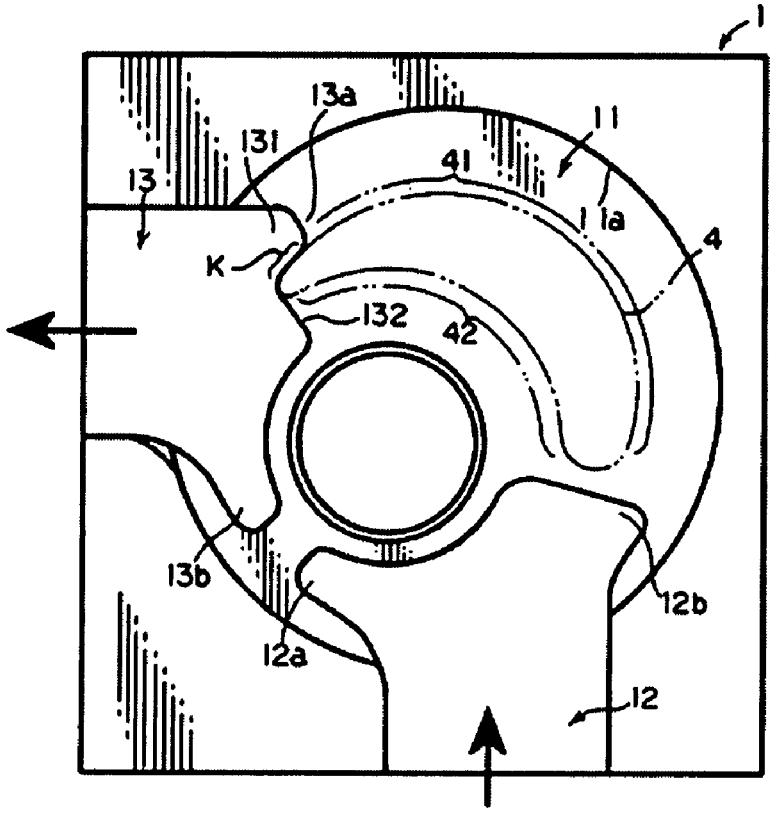
FIG. 1B is a plan view showing the rotor chamber and the inlet and outlet ports of the pump housing.

The following is an explanation of the embodiments of the present invention based on the drawings. The structure of the present invention includes mainly a pump casing 1, an outer rotor 2, an inner rotor 3, and a crescent 4, as shown in FIG. 1A. As shown in FIG. 1B, a rotor chamber 11, an inlet port 12, and an outlet port 13 are formed in the pump casing 1. Also, the inlet port 12 and the outlet port 13 connect with the flow path outside the pump casing 1. Also, the pump casing 1 is used with a pump cover, which is not shown in the drawings.

The inlet port 12 includes a starting portion 12*a* and a finishing portion 12*b*. Also, the outlet port 13 includes a starting portion 13*a* and a finishing portion 13*b* (see FIG. 1B). The starting portions 12*a*, 13*a* of the inlet port 12 and the outlet port 13 are the sides from which tops of teeth 21 and 31, which are described later, enter, and the finishing portions 12*b*, 13*b* are the sides from which the tops of the teeth 21 and 31 exit, when the outer rotor 2 and the inner rotor 3 rotate.

Next, as shown in FIG. 1A, the outer rotor 2 is formed in a ring shape. On the inside of the outer rotor 2 the plurality of tooth top portions 21 is formed, and tooth base portions 22 are formed between adjacent tooth top portions 21. On the outer periphery of the inner rotor 3 the plurality of tooth top portions 31 is formed, and between adjacent tooth top portions 31 tooth base portions 32 are formed. The outer rotor 2 is disposed to the outer peripheral side of the inner rotor 3, and the tooth top portions 31 of the inner rotor 3 mesh with the tooth base portions 22 of the outer rotor 2.

The number of tooth top portions 31 on the inner rotor 3 is fewer than the number of tooth top portions 21 in the outer rotor 2 by a factor of two or more. The outer rotor 2 is rotatably supported by the inner peripheral wall 11*a* of the rotor chamber 11, so that the position of the center of the outer rotor 2 is fixed with respect to the rotor chamber 11. Also, the inner rotor 3 is fixed to a drive shaft that penetrates the rotor chamber 11, and is rotated by the drive shaft. Also, the inner rotor 3 is disposed to the inside of the outer rotor 2 so that the center of the inner rotor 3 is eccentric to the center of the outer rotor 2, and so that the tooth top portions 31 of the inner rotor 3 are set to mesh with the tooth base portions 22 of the outer rotor 2. The arrow symbol in the circumferential direction shown in FIGS. 1A, 3, and 4 indicates the direction of rotation of the outer rotor 2 and the inner rotor 3. Also, the teeth on the outer rotor 2 and the inner rotor 3 are formed as trochoidal-shaped teeth. In other words, the tooth top portions 21 and the tooth base portions 22 of the outer rotor 2 are formed in a trochoidal shape. Also, the tooth top portions 31 and the tooth base portions 32 of the inner rotor 3 are formed in a trochoidal shape, so that they mesh with the tooth top portions 21 and the tooth base portions 22. Also, the outer rotor 2 and the inner rotor 3 are not limited to trochoidal tooth forms; other types of tooth shape may be used.

Next, as shown in FIG. 1A, the crescent 4 is inserted and disposed in a gap S formed between the outer rotor 2 and the inner rotor 3. The gap S is the approximately crescent moon-shaped space formed between the inside of the outer rotor 2 and the outer periphery of the inner rotor 3. The crescent 4 has an approximately crescent moon-shape or an arc shape, that includes an arc-shaped convex surface side 41 and an arc-shaped concave surface side 42. The crescent 4 is housed in the gap S, with the tooth top portions 21 and 31 in contact with the arc-shaped convex surface side 41 and the arc-shaped concave surface side 42 of the crescent 4 respectively. Also, one end of the crescent 4 is disposed near the finishing portion 12*b* of the inlet port 12, and the other end of the crescent 4 is disposed near the starting portion 13*a* of the outlet port 13.

The tooth top portions 21 of the outer rotor 2 contact the arc-shaped convex surface side 41 of the crescent 4, and form void portions in the space enclosed by the arc-shaped convex surface side 41 and the tooth base portions 22. These void portions are referred to as cells. In particular the cells formed by the tooth base portions 22 of the outer rotor 2 and the arc-shaped convex surface side 41 are referred to as outer cells 5. In the same way, the tooth top portions 31 of the inner rotor 3 contact the arc-shaped concave surface side 42 of the crescent 4, and form void portions in the space enclosed by the arc-shaped concave surface side 42 and the tooth base portions 32. These void portions are referred to as inner cells 6 (see FIG. 1A).

When the inner rotor 3 is rotated by the drive shaft, the outer rotor 2 rotates. As the outer rotor 2 rotates, near the finishing portion 12*b* of the inlet port 12, the tooth top portions 21 move from one end in the length direction of the arc-shaped convex surface side 41 of the crescent 4 towards the other end in the length direction while contacting the arc-shaped convex surface side 41 (see FIGS. 3A, 4A). The tooth top portions 21 gradually separate from the surface of the arc-shaped convex surface side 41 of the crescent 4 near the other end in the length direction (see FIGS. 3B, 4B). As the tooth top portions 21 separate from the arc-shaped convex surface side 41, the outer cells 5 link with the outlet port 13, the fluid in the outer cells 5 flows into the outlet port 13, and the fluid is discharged.

Figure 3A:
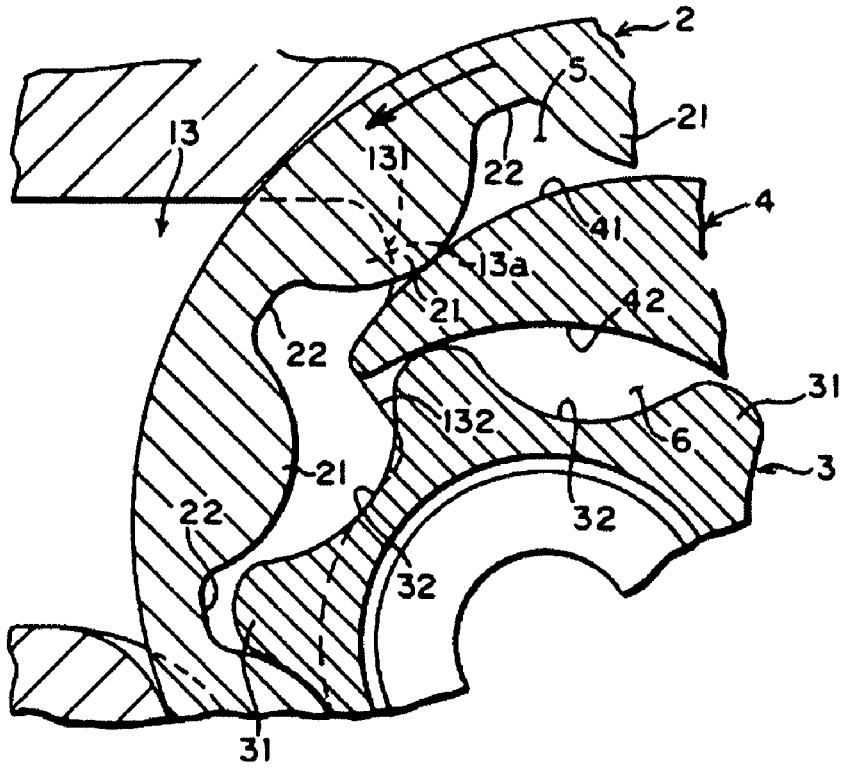
FIG. 3A is an enlarged transverse plan view showing the state in which the cell on the outside and the cell on the inside have not linked with the outlet port.
Figure 3B:
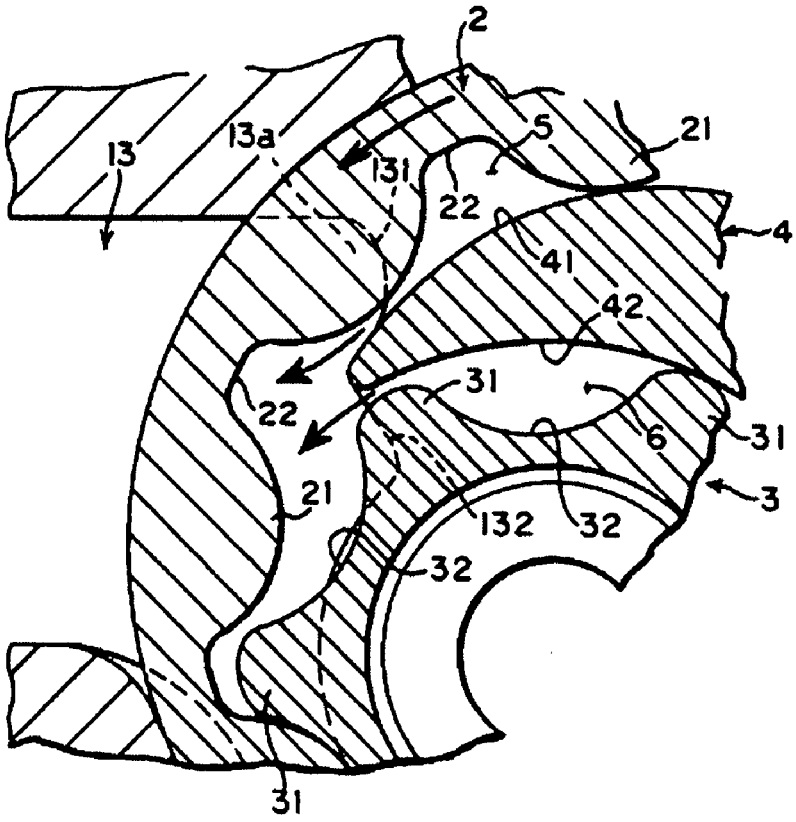
FIG. 3B is an enlarged transverse plan view showing the state in which the cell on the outside and the cell on the inside have linked with the outlet port.
Figure 4A:
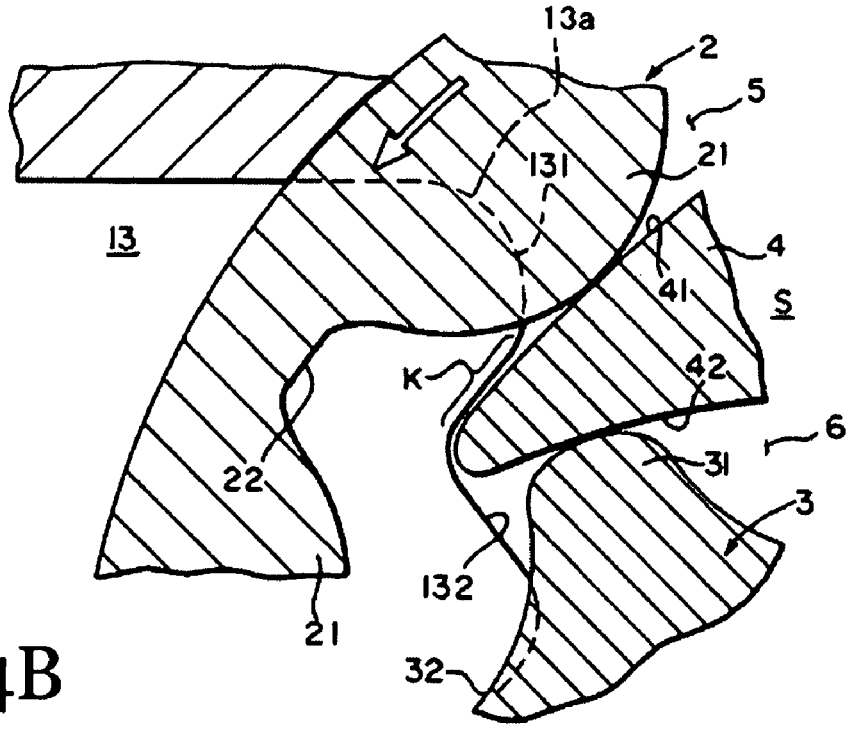
FIG. 4A is an enlarged transverse plan view showing the state in which the top of the gear tooth of the outer rotor and the inner rotor are in contact with the arc-shaped convex surface side and the arc-shaped concave side of the crescent.

In the same way, as the inner rotor 3 rotates, near the finishing portion 12*b* of the inlet port 12, the tooth top portions 31 move from one end in the length direction of the arc-shaped concave surface side 42 of the crescent 4 towards the other end in the length direction while contacting the arc-shaped concave surface side 42 (see FIGS. 3A, 4A). The tooth top portions 31 gradually separate from the surface of the arc-shaped concave surface side 42 of the crescent 4 near the other end in the length direction (see FIGS. 3B, 4B). As the tooth top portions 31 separate from the arc-shaped concave surface side 42, the inner cells 6 link with the outlet port 13, the fluid in the inner cells 6 flows into the outlet port 13, and the fluid is discharged.

FIG. 4A shows the state just before the tooth top portion 21 of the outer rotor 2 and the tooth top portion 31 of the inner rotor 3 start to separate from the crescent 4. Both the tooth top portion 21 of the outer rotor 2 and the tooth top portion 31 of the inner rotor 3 are in contact with the arc-shaped convex surface side 41 and the arc-shaped concave surface side 42 of the crescent 4 respectively, forming sealed (including approximately sealed) outer cells 5 and inner cells 6.

Figure 4B:
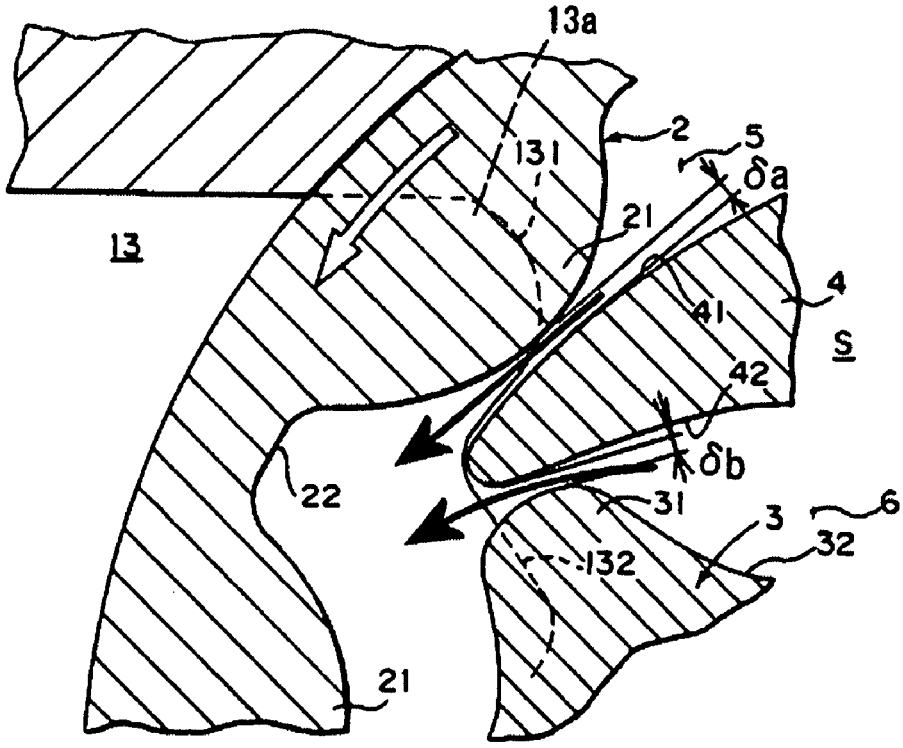
FIG. 4B is an enlarged transverse plan view showing the state in which the top of the gear tooth of the outer rotor and the inner rotor have simultaneously started to separate from the arc-shaped convex surface side and the arc-shaped concave side of the crescent.

FIG. 4B shows the instant that the tooth top portion 21 of the outer rotor 2 and the tooth top portion 31 of the inner rotor 3 start to simultaneously (including approximately simultaneously) separate from the arc-shaped convex surface side 41 and the arc-shaped concave surface side 42 of the crescent 4. The fluid filling the outer cell 5 and the inner cell 6 simultaneously (including approximately simultaneously) flows into the outlet port 13. FIG. 4B shows that the dimension δa of the gap between the tooth top portion 21 of the outer rotor 2 and the arc-shaped convex surface side 41 of the crescent 4 and the dimension δb of the gap between the tooth top portion 31 of the inner rotor 3 and the arc-shaped concave surface side 42 of the crescent 4 are the same (including approximately the same).

Also, the time that the outer cell 5 starts to link with the outlet port 13 is the same (including approximately the same) as the time that the inner cell 6 starts to link with the outlet port 13. Here, perfectly simultaneous is ideal, but approximately simultaneous is included in the concept of simultaneous. Approximately simultaneous indicates a very small time difference. In other words, a very small time difference between the time that the outer cell 5 and the inner cell 6 start to link with the outlet port 13 is equivalent to the time difference for which the fluid pressure difference between the outer cell 5 and the inner cell 6 is almost zero.

In this way, at the position of the starting portion 13*a* of the outlet port 13, the tooth top portion 21 of the outer rotor 2 and the tooth top portion 31 of the inner rotor 3 simultaneously separate from the arc-shaped convex surface side 41 and the arc-shaped concave surface side 42 of the crescent 4. The outer cell 5 and inner cell 6 simultaneously link with the outlet port 13. As shown in FIGS. 3B and 4B, the fluid filling the outer cell 5 and the inner cell 6 simultaneously flows into the outlet port 13, so the difference in the internal pressure of the outer cell 5 and the inner cell 6 immediately after starting to link with the outlet port 13 is eliminated. In other words, the difference in pressure on the arc-shaped convex surface side 41 and the arc-shaped concave surface side 42 of the crescent 4 is eliminated, so it is possible to prevent small vibrations of the crescent 4.

The shape of the starting portion 13*a* of the outlet port 13 is the shape for which the time at which the outer cell 5 starts to link with the outlet port 13 and the time at which the inner cell 6 starts to link with the outlet port 13 are simultaneous (including approximately simultaneously), as stated previously. Specifically, as shown in FIG. 1B and FIG. 2, in the starting portion 13*a* of the outlet port 13, a port projection portion 131 is formed in which the outer periphery side of the outlet port 13 projects along the circumferential direction.

In other words, the part at the starting portion 13*a* of the outlet port 13 and near the inner peripheral side surface 11*a* of the rotor chamber 11 is formed projecting towards the finishing portion 12*b* of the inlet port 12 along the circumferential direction. The port projection portion 131 has a path width that is approximately half the port width (the direction along the diametral direction of the rotor chamber 11) at the starting portion 13*a* of the outlet port 13.

Also, in the starting portion 13*a*, the portion in which the port projection portion 131 is not formed is referred to as the non-projecting starting edge 132. The port projection portion 131 is the area where the tooth top portions 21 of the outer rotor 2 pass, and the non-projecting starting edge 132 is the area where the tooth top portions 31 of the inner rotor 3 pass.

Figure 2:
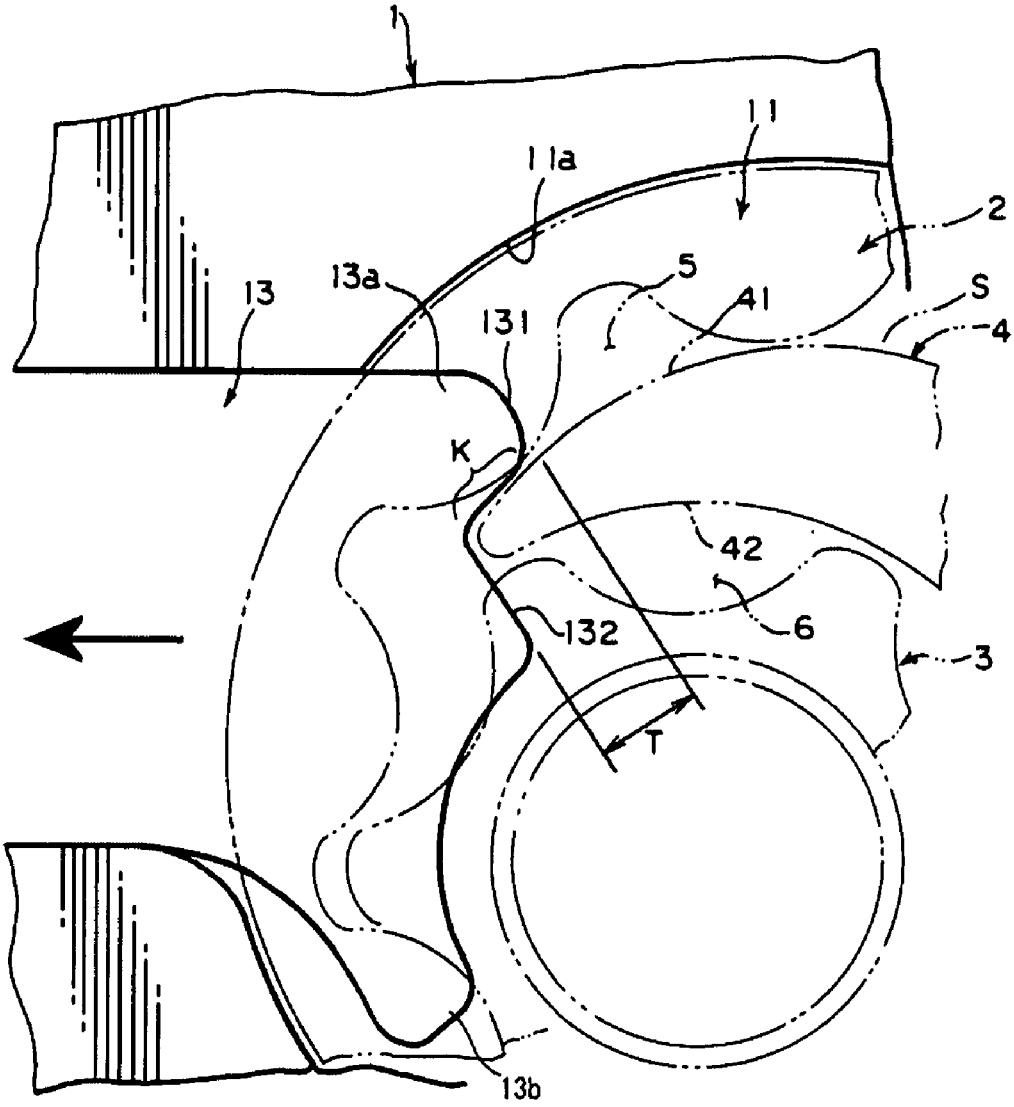
FIG. 2 is an enlarged plan view of the outlet port.

The projection length T of the port projection portion 131 from the non-projecting starting edge 132 is set so that the time at which the tooth top portion 31 of the inner rotor 3 starts to separate from the arc-shaped concave surface side 42 of the crescent 4 and the inner cell 6 starts to link with the non-projecting starting edge 132, and the time at which the tooth top portion 21 of the outer rotor 2 starts to separate from the arc-shaped convex surface side 41 of the crescent 4 and the outer cell 5 starts to link with the port projection portion 131 is simultaneous (see FIG. 2).

Furthermore, the shape of the continuity area K, which is the portion that connects the port projection portion 131 and the non-projecting starting edge 132 of the outlet port 13 in the circumferential direction, is formed so that its shape approximately coincides with the shape of the arc-shaped convex surface side 41 of the crescent 4 on the side near its other end (see FIG. 2). In other words, the continuity area K is formed in an approximate arc-shape that is similar to the outer peripheral shape of the arc-shaped convex surface side 41 of the crescent 4 near the outlet port 13 end. In this way, when the outer cells 5 link with the outlet port 13, the fluid in the outer cells 5 can smoothly flow into the outlet port 13.

What is claimed is:

1. An internal gear pump comprising:

a pump casing;

an outer rotor;

an inner rotor disposed on an inner peripheral side of the outer rotor;

a crescent disposed in a gap between the inner rotor and the outer rotor;

outer cells formed by the crescent and the outer rotor; and inner cells formed by the crescent and the inner rotor, wherein a port projection portion projecting along a circumferential direction towards a finishing end portion of an inlet port so as to extend across an area, over which tooth top portions of the outer rotor pass, is formed in an outer peripheral side of a starting end portion of an outlet port, a section of an end of the port projection portion being a position at which the tooth top portions of the outer rotor start to separate from the surface of an arc-shaped convex surface side of the crescent, wherein a continuity area of a portion which continues along a circumferential direction between the port projection portion of the outlet port and a non-projection starting edge where the port projection portion is not formed, towards the finishing end portion of the inlet port, is formed substantially in an arc shape similar to an outer peripheral shape of the arc-shaped convex surface side on an outlet port side of the crescent, and wherein the continuity area having a projection length of the port projecting portion from the non-projecting starting edge until the port projection portion is set in such a manner that linking of the port projection portion of the outlet port in the pump casing to the outer cells due to gradual separation of the surface of the arc-shaped convex surface side of the crescent from the tooth top portions of the outer rotor, and linking of the non-projecting starting edge of the outlet port to the inner cells due to gradual separation of a concave surface of the arc-shaped surface side of the crescent from the tooth top portions of the inner rotor occur substantially simultaneously.

2. The internal gear pump according to claim 1, wherein the teeth of the outer rotor and the inner rotor are in trochoidal form.

3. The internal gear pump according to claim 1, wherein a number of tooth top portions on the inner rotor are fewer than a number of tooth top portions on the outer rotor.

4. The internal gear pump according to claim 1, wherein a number of tooth top portions on the inner rotor are fewer than a number of tooth top portions on the outer rotor by a factor of two or more.

5. The internal gear pump according to claim 1, further comprising a drive shaft which rotates the inner rotor.

6. The internal gear pump according to claim 1, wherein the port projection portion, at the starting end portion of an outlet port, has a path width that is substantially equal to half of a width of the outlet port.

* * * * *